United States Patent [19]

Kocher et al.

[11] 4,178,051

[45] Dec. 11, 1979

[54] LATCH/EJECT PIN HEADER

[75] Inventors: Timothy L. Kocher; Benny M. Bennett, both of Harrisburg, Pa.

[73] Assignee: AMP Incorporated, Harrisburg, Pa.

[21] Appl. No.: 917,762

[22] Filed: Jun. 21, 1978

[51] Int. Cl.[2] ..... H01R 13/62

[52] U.S. Cl. ..... 339/45 M

[58] Field of Search ..... 339/45, 46, 91 R

[56] References Cited

U.S. PATENT DOCUMENTS

| | | | |
|---|---|---|---|
| 3,150,906 | 9/1964 | Chambon et al. | 339/45 M |
| 3,784,954 | 1/1974 | Grimm et al. | 339/45 M |

*Primary Examiner*—Joseph H. McGlynn

*Attorney, Agent, or Firm*—Russell J. Egan

[57] ABSTRACT

A latch/eject pin header is disclosed which provides both positive locking of a connector in a header and positive ejection of the connector upon disconnect. The subject header includes an elongated housing defining an elongated cavity therein with a plurality of pin terminals fixed in the base of the cavity and latching members pivotally mounted at the ends of the cavity. Each latching member includes a latching arm for engaging the mating connector, an eject arm for levering the connector from the cavity, and an actuating arm to effect pivotal movement of the latching member.

8 Claims, 4 Drawing Figures

Fig. 1
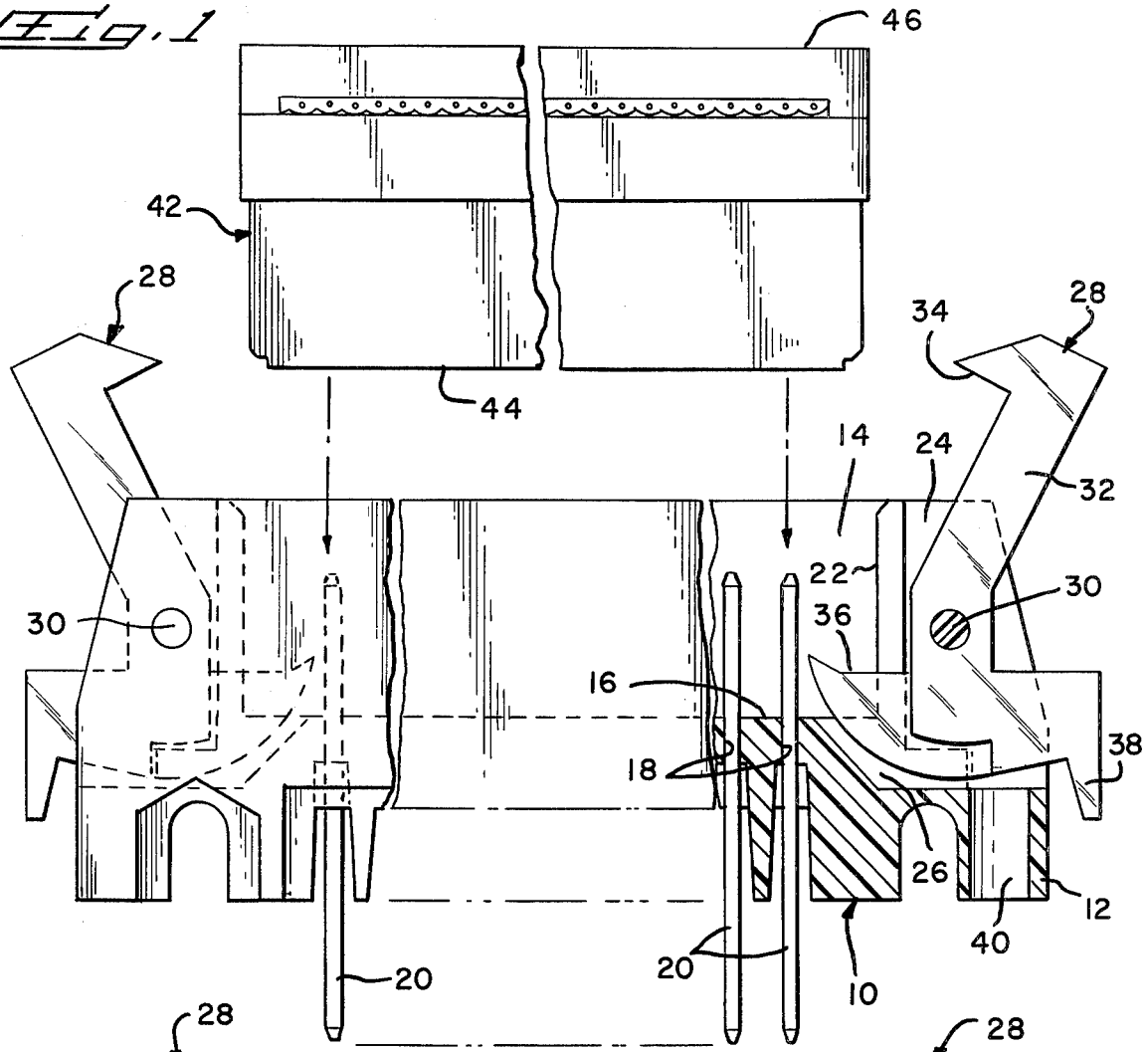
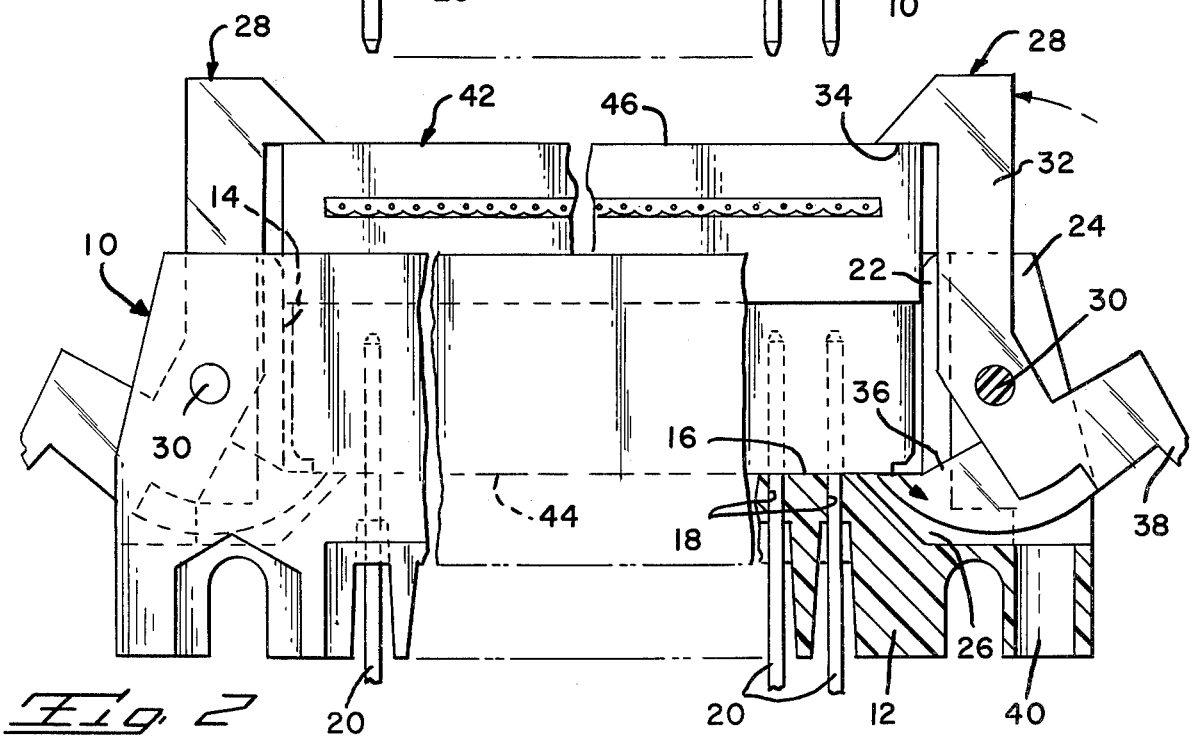
Fig. 2

LATCH/EJECT PIN HEADER

BACKGROUND OF THE INVENTION

1. The Field Of The Invention

The present invention relates to a latch/eject pin header and in particular to a pin header which needs only one hand to effect either latching of a connector into the header or ejection of the connector from the header.

2. The Prior Art

It is well known in the electrical connector industry to provide pin headers to act as shrouds protecting an array of pin terminals as well as to provide polarization for a mating connector. It is also known to provide latching means on such pin headers to secure the connector in the header in a mated condition. However, some of these latched arrangements are quite inconvenient when it is desired to unmate the connector. Since most of the connectors are held in the pin header by frictional engagement between the female contacts carried by the connector and the male pins in the header, there is sometimes substantial force which must be overcome during the unmating operation. In such instances it is often desirable to have a means for helping eject the connector from the header.

An example of one such device is shown in U.S. Pat. No. 4,070,081 in which a pair of coupling members are rotatably mounted so that latches on a first end of the members can secure the connector in position while lifting fingers on the opposite end of the members can be used to eject the connector from the header. However, the operation of these members is such that it is necessary to employ a two-handed operation, especially when ejecting the connector from the header.

SUMMARY OF THE INVENTION

The present invention overcomes the difficulties of the prior art by producing a latch/eject pin header which can be operated by one hand in both the latching and ejecting modes. The subject latch/eject pin header includes an elongated housing defining an elongated connector receiving cavity having a plurality of pin terminals fixedly engaged therein. At each end of the connector there is a pivotally mounted lever having a latch arm on one portion thereof, an integral eject arm on a second portion thereof, and an actuating arm. The pivot point of the lever is so located that, when a mating connector is inserted into the header, it engages the eject arms causing the latching arms to be rotated into a latching condition engaging the connector. The actuating arms are squeezed together to cause a reverse rotational action which releases the latching arms while simultaneously pushing the eject arms against the mating face of the connector to force it out of the cavity of the header.

It is therefore an object of the present invention to produce an improved latch/eject pin header which can be operated by one hand.

It is another object of the present invention to produce an improved latch/eject pin header having a lever action about a fulcrum which creates a mechanical advantage for unmating an associated connector.

It is another object of the present invention to produce a latch/eject pin header which will both effectively latch a mating connector into the header and will assist in the removal of the connector during ummating.

It is still another object of the present invention to produce a latch/eject pin header which will uniformly unmate an associated connector thereby precluding damage to the pin terminals.

It is a further object of the present invention to produce a latch/eject pin header which can be readily and economically produced.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 1 is a side elevation, partly in section, of the subject latch/eject pin header with a mating connector exploded therefrom;

FIG. 2 is a side elevation, similar to FIG. 1, showing the mating connector fully engaged in the subject pin header;

DETAILED DESCRIPTION OF THE PREFERRED EMBODIMENT

Figure 3:
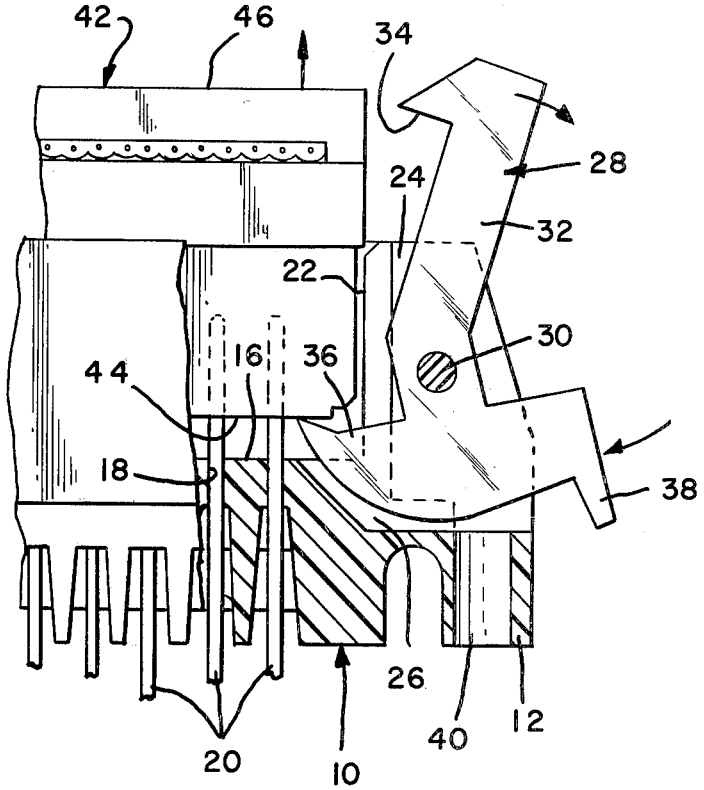
FIG. 3 is a side elevation, partially in section, showing the actuation at one end of the subject latch/eject pin header.

The subject latch/eject pin header 10 includes an elongated housing 12 defining an elongated cavity 14 therein. The base 16 of the cavity has a plurality of apertures 18 in which a like plurality of terminal pins 20 are fixed. The cavity may also be profiled with polarizing and/or keying projections 22. At each end of the housing 12 there is a lever recess 24 including a passage 26 leading to the cavity 14. A lever member 28 is pivotally mounted in each recess 24 by a pivot pin 30. Each lever member 28 includes a latching arm 32 having an inwardly directed shoulder 34 on a free end thereof, an eject lever 36 extending through the passage 26, and an actuation arm 38 extending opposite the ejection lever 36. Both the eject lever 36 and the actuation arm 38 lie on one side of the pivot pin 30 opposite the latching arm 32. The housing 12 can also include mounting recesses or apertures 40 at the opposite ends thereof.

The subject latch/eject pin header mates with a connector 42 which is of well known design, for example, the connectors shown in U.S. Pat. Nos. 3,663,922; 3,699,502 or 3,707,696.

The latching arms 32 are positioned as shown in FIG. 1 to receive the connector 42. This positioning can be readily achieved by depressing the action arms 38 by pressing them together. The connector 42 is then inserted into the header 10 with mating face 44 engaging the eject arms 36 and causing the rotation of the lever member 28 about their pivot pins 30 until the latching arm shoulders 34 engage the back surface 46 of the connector 42. This is the position shown in FIG. 2 with mating face 44 of connector 42 engaging the base 16 of cavity 14. The connector is thus fully engaged and held in the housing. When it is desired to remove the connector from the header, it is only necessary to depress the actuating arms 38 by squeezing them together causing a rotation of the lever members 28 about their pivot pins 30 and the shoulders 34 to be freed from engagement with the back surface 46 of the connector 42. Continued rotation of the lever members 28 causes the eject arms 36 to come into engagement with the mating face 44 of the connector 42 to push it upwardly off of the terminal pins 20.

Figure 4:
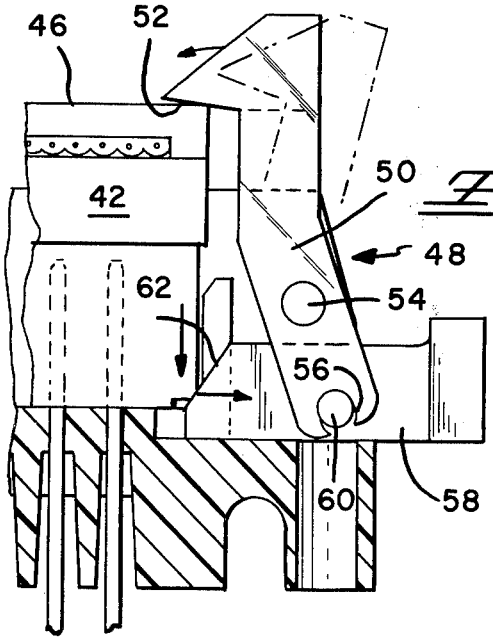
FIG. 4 is a side elevation of an end section of an alternate embodiment of the present invention.

An alternate embodiment of the subject latch/eject header is shown in FIG. 4 with one piece lever member 28 of the preferred embodiment being replaced by a two piece actuation assembly 48 including a latching arm 50 having an inwardly directed shoulder 52 on one free end thereof, a pivot pin 54 intermediate the ends, and a recess 56 in the opposite free end of the latching arm 50. An actuating member 58 has a pin 60 mounted thereon engaging in the recess 56 of the latching arm 50 and has a cam surface 62 on the free end thereof. The actuation of this member is substantially the same as the preferred embodiment. Inward movement of the actuating members 58, by squeezing towards the housing, will cause the rotation of the latching arm 50 about pivot pin 54 until the shoulder 52 clears the back 46 of the connector 42 and the cam surface 62 engages an end portion of the mating face 44 of the connector to cam it out of mating engagement with the terminal pins of the header. Likewise insertion of the connector into the header will cause an outward movement of the actuation arms 58 and a latching rotation of the latching arms 50.

The present invention may be subject to many modifications and changes without departing from the spirit or essential characteristics thereof. The present embodiment should therefore be considered in all respects as illustrative and not restrictive of the invention.

What is claimed is:

1. A latch/eject pin header comprising:

an elongated housing defining an elongated cavity adapted to receive a mating connector therein;

a plurality of terminal pins fixedly mounted in said cavity;

latch/eject means at each end of said housing, said latch/eject means having a latch arm portion adapted to latchingly engage said connector mated in said header, an eject portion extending into said cavity to engage a mating face of said connector, an actuation portion adapted to impart a rotary motion to said latch/eject means upon squeezing together of the actuating portions at the opposite ends of said housing, and pivot pin means passing through an intermediate section of said latch arm portion rotatably mounting said latch/eject means in said housing, said eject portion and said actuation portion extending in substantially opposite directions to one side of said pivot pin, and substantially normal to said latch arm portion on the opposite side of said pivot pin, whereby insertion of said mating connector into said housing brings the connector into driving engagement with said eject portion causing rotation of said latch arm portions into latching engagement with said connector and squeezing together of said actuation portions causes reverse rotation freeing said latch arm portions from said connector and driving said eject portion against said connector to remove it from said housing.

2. A latch/eject pin header assembly for receiving a male connector member therein, said header comprising:

an elongated housing defining an elongated cavity adapted to receive said connector member therein;

a plurality of terminal pins fixedly mounted in said cavity;

latch/eject means rotatably mounted at each end of said housing for ejection said connector into said housing and for ejecting said connector from said housing, said latch/eject means being a unitary member having a lever arm portion with a connector engaging shoulder on a free end, an ejection portion extending into said cavity to engage with a mating face of said connector, and an actuation portion adapted to impart a rotary motion to said latch/eject means upon squeezing together of the actuating means at the opposite ends of said housing, said latch/eject means further comprising a pivot pin passing through an intermediate portion of said lever arm portion to rotatably mount said means in said housing, said ejection portion and said actuation portion extending in substantially opposite directions on one side of said pivot pin and said lever arm portion extending substantially normal to said ejection and actuation portions from the other side of said pivot pin, whereby engagement of said mating face of a connector with said ejectio portion causes rotation of said latch/eject means in a first direction to bring said lever arm shoulder into latching engagement with said connector and squeezing of said actuating means causes rotation in a reverse direction to release said lever arm and cause lifting of said connector from said housing by said eject means.

3. A latch/eject pin header assembly according to claim 2 wherein said housing further comprises means for mounting said housing on a panel.

4. A latch/eject pin header assembly according to claim 2 wherein said cavity is profiled for polarized mating with said connector.

5. A latch/eject pin header comprising:

an elongated housing defining an elongated cavity adapted to receive a mating connector therein;

a plurality of terminal pins fixedly mounted in said cavity;

latch/eject means at each end of said housing, each said latch/eject means comprising:

a latching lever pivotably mounted intermediate the ends thereof, a latching shoulder on one end of said lever adapted to latchingly engage said connector mated in said header, and a recess on the other end of said lever; and actuating arm means adapted to impart motion to said latch/eject means upon squeezing together of the actuating portions at the opposite ends of said housing, a pin means intermediate the ends of said actuating arm means engaging in said recess in said latching lever, and a cam surface on a free end of said actuating arm means extending into said cavity to impart an ejection motion to a mating face of said connector inserted therein;

whereby insertion of said mating connector into said housing brings the connector into driving engagement with said eject portion causing rotation of said latch arm portions into latching engagement with said connector and squeezing together of said actuation portions causes reverse rotation freeing said latch arm portions from said connector and driving the cam surface against said connector to remove it from said housing.

6. A latch/eject pin header assembly to be mounted on a circuit board or the like enclosing and protecting an array of fixed pin terminals and receiving a mating male connector member therein, said header assembly comprising:

an elongated housing of insulative material defining an elongated cavity adapted to receive said connector member therein;

a plurality of terminal pin apertures in a base portion of said cavity;

latch/eject means rotatably mounted at each end of said housing for latching said connector into said housing and for ejecting said connector from said housing, said latch/eject means having a lever arm portion pivotally mounted intermediate the ends thereof with a connector engaging shoulder on one free end and a recess in the other free end, and an actuation arm having a pin means intermediate the ends thereof engaging in said recess in said lever arms, and a cam surface on a free end of said actuating arm means extending into said cavity to impart a lifting motion to said connector inserted therein upon squeezing together of the actuating means at the opposite ends of said housing;

whereby engagement of said mating face of a connector with said cam surface causes rotation of said latch/eject means in a first direction to bring said lever arm shoulder into latching engagement with said connector and squeezing of said actuating means causes rotation in a reverse direction to release said lever arm and cause lifting of said connector from said housing by said cam surface.

7. A latch/eject pin header for use in engaging a flat flexible cable terminated with a known connector with an array of pin terminals fixed in a circuit board, said header comprising:

an elongated housing of rigid insulative material having intersecting sidewalls and a base defining therebetween an elongated blind cavity adapted to receive a mating connector therein, said base being adapted to be mounted on a circuit board and having therein a plurality of apertures aligned to receive a respective terminal pin of said array extending into said cavity;

latch/eject means at each end of said housing, each said latch/eject means being a unitary member having a latch arm portion with a free end adapted to latchingly engage a connector mated in said header, an eject portion extending into said cavity and adapted to engage a mating face of said connector, an actuation portion adapted to impart an ejecting motion to said latch/eject means upon squeezing together of the actuating portions at the opposite ends of said housing, and a pivot pin passing through an intermediate section of said latch arm portion and rotatably mounting said latch/eject means in said housing, said actuation portion and said eject portion extending in substantially opposite directions to one side of said pivot pin and substantially normal to the longitudinal axis of said latch arm portion, whereby insertion of said mating connector into said housing brings the connector into driving engagement with said eject portion causing movement of said latch arm portions into latching engagement with said connector and squeezing together of said actuation portions causes reverse movement freeing said latch arm portions from said connector and driving said eject portion against the mating face of said connector to remove it from said housing.

8. A latch/eject pin header assembly to be mounted on a circuit board or the like enclosing and protecting an array of pin terminals fixed in the circuit board and receiving a male connector member therein, said header comprising:

an elongated housing of rigid insulative material defining an elongated blind cavity with side walls surrounding said pin array and an apertured base admitting said pins to said cavity;

latch/eject means rotatably mounted at each end of said housing for latching said connector into said housing and for ejecting said connector from said housing, each said latch/eject means being a unitary member with a pivot pin mounting it in said housing each said member having a lever arm portion extending in a first direction from said pivot pin with a connector engaging shoulder on a free end, an ejection portion extending in a second direction from and on the opposite side of said pin substantially normal to said first direction and into said cavity to engage with a mating face of said connector, and an actuation portion extending in a third direction substantially opposite said second direction and adapted to impart a rotary motion to said latch/eject means about said pivot pin upon squeezing together of the actuating portions at the opposite ends of said housing, whereby engagement of said mating face of a connector with said ejection portion causes rotary movement of said latch/eject means in a first direction to bring said lever arm shoulder into latching engagement with said connector and squeezing of said actuating means causes rotary movement in a reverse direction to release said lever arm and cause lifting of said connector from said housing by said eject means.

* * * * *